US009752356B2

(12) United States Patent
Tamaki

(10) Patent No.: US 9,752,356 B2
(45) Date of Patent: Sep. 5, 2017

(54) LOCK RELEASE APPARATUS AND LOCK APPARATUS HAVING THE SAME

(71) Applicant: PIOLAX, INC., Yokohama (JP)

(72) Inventor: Satoru Tamaki, Yokohama (JP)

(73) Assignee: PIOLAX, INC., Yokohama-Shi, Kanagawa (JP)

( * ) Notice: Subject to any disclaimer, the term of this patent is extended or adjusted under 35 U.S.C. 154(b) by 70 days.

(21) Appl. No.: 14/871,681

(22) Filed: Sep. 30, 2015

(65) Prior Publication Data

US 2016/0097225 A1 Apr. 7, 2016

(30) Foreign Application Priority Data

Oct. 1, 2014 (JP) ..... 2014-203363

(51) Int. Cl.

| | |
|---|---|
| ***E05C 1/02*** | (2006.01) |
| ***E05B 83/30*** | (2014.01) |
| *E05C 9/00* | (2006.01) |
| *E05C 9/04* | (2006.01) |
| *E05B 1/00* | (2006.01) |

(52) U.S. Cl.

CPC ..... *E05B 83/30* (2013.01); *E05B 1/0038* (2013.01); *E05C 9/002* (2013.01); *E05C 9/043* (2013.01)

(58) Field of Classification Search

CPC .... E05C 9/041; E05C 9/042; Y10T 292/0977; E05B 83/30; E05B 1/0038

USPC ..... 292/137

See application file for complete search history.

(56) References Cited

U.S. PATENT DOCUMENTS

| | | | | |
|---|---|---|---|---|
| 7,380,308 | B2 * | 6/2008 | Oh | A47L 9/1463 15/327.2 |
| 8,608,245 | B2 * | 12/2013 | Wieclawski | B60N 2/366 292/137 |
| 8,640,301 | B1 * | 2/2014 | Lee | A47L 9/1691 15/327.2 |
| 2008/0040883 | A1 * | 2/2008 | Beskow | A47L 5/225 15/329 |

FOREIGN PATENT DOCUMENTS

WO WO 2013/187388 A1 12/2013

* cited by examiner

*Primary Examiner* — Matthew Ing

(74) *Attorney, Agent, or Firm* — McGinn IP Law Group, PLLC.

(57) ABSTRACT

An embodiment provides a lock-release apparatus including: a rotation member to actuate a locking member; a case member rotatably supporting the rotation member; an operation member slidable in a direction substantially in parallel to a rotation plane of the rotation member; and a spring member urging the rotation member in a given rotation direction. The lock-release apparatus further includes a link structure converting a sliding movement of the operation member into a rotational movement of the rotation member. More specifically, the case member includes: an accommodation section slidably accommodating the operation member to allow an operation face thereof to be exposed; and a support section rotatably supporting the rotation member.

8 Claims, 10 Drawing Sheets

LOCK RELEASE APPARATUS AND LOCK APPARATUS HAVING THE SAME

CROSS-REFERENCE TO RELATED APPLICATION(S)

This application claims priority from Japanese Patent Application No. 2014-203363 filed on Oct. 1, 2014, the entire contents of which are incorporated herein by reference.

FIELD

The present invention relates to a lock-release apparatus that is installed on a install-base member and a lock apparatus equipped with the lock-release apparatus.

BACKGROUND

The glove box of a vehicle is provided with an opening/closing member for opening and closing the opening section thereof, and a lock apparatus for holding the opening/closing member in a closed state is installed on the glove box. The user unlocks the opening/closing member by operating the operation member of the lock apparatus and opens the opening section of the glove box.

For example, WO-2013-187388-A discloses a lock apparatus for locking a lid for opening/closing the opening section of the glove box of a vehicle. This lock apparatus is equipped with an operation member that can be slid when pushed by the user; a rotation member that is connected to the operation member and rotated by the sliding of the operation member; a housing for supporting the operation member and the rotation member; and a link rod connected to the rotation member. The connection pin of the rotation member connected to the link rod is provided at the outer circumferential end of the rotation member having a cylindrical shape. The link rod sets the lid to a locked state or an unlocked state depending on the rotation of the rotation member. The rotation member is disposed so that the rotation plane thereof is orthogonal to the sliding direction of the operation member.

In WO-2013-187388-A, when the rotation radius of the connection pin is made larger by making the radius of the rotation member larger, the movement distance of the connection pin with respect to the rotation angle thereof is made larger and the ratio of the output to the input can be made larger. However, in the case that the radius of the rotation member is made larger sufficiently, the area of the rotation member is increased and the lock apparatus is made larger in the direction along the rotation plane of the rotation member. Since the rotation member of WO-2013-187388-A has the rotation plane orthogonal to the sliding direction of the operation member, the lock apparatus becomes larger in the direction along the rotation plane of the rotation member, that is, in the direction orthogonal to the sliding direction.

SUMMARY

An aspect of the present invention provides a lock-release apparatus including:

a rotation member including an actuation section that rotates to actuate a locking member;

a case member rotatably supporting the rotation member;

an operation member slidable in a direction substantially in parallel to a rotation plane of the rotation member;

a spring member making contact with both the case member and the rotation member to thereby urge the rotation member in a given rotation direction; and a link structure converting a sliding movement of the operation member into a rotational movement of the rotation member, wherein the case member includes:

an accommodation section slidably accommodating the operation member to allow an operation face thereof to be exposed; and a support section rotatably supporting the rotation member.

Another aspect of the present invention provides a lock apparatus configured to lock an opening/closing member openably and closably installed on an opening section of an install-base member in a closed state, the lock apparatus including:

a locking member capable of being brought into a locked state to thereby hold the opening/closing member when the opening/closing member is closed;

a rotation member including an actuation section that rotates to actuate the locking member;

a case member being installed on one of the install-base member and the opening/closing member and rotatably supporting the rotation member;

an operation member slidable in a direction substantially in parallel to a rotation plane of the rotation member;

a wound-formed spring member making contact with both the case member and the rotation member to thereby urge the rotation member in a direction in which the locking member is brought into the locked state; and a link structure converting a sliding movement of the operation member into a rotational movement of the rotation member, wherein the case member includes:

an accommodation section slidably accommodating the operation member to allow an operation face thereof to be exposed; and a support section rotatably supporting the rotation member, and wherein, upon operation on the operation member, the operation member slides to cause the rotation member to rotate via the link structure to thereby actuate the locking member.

According to the above configurations, a lock-release apparatus can be made compact in a given direction.

DETAILED DESCRIPTION

Figure 1A:
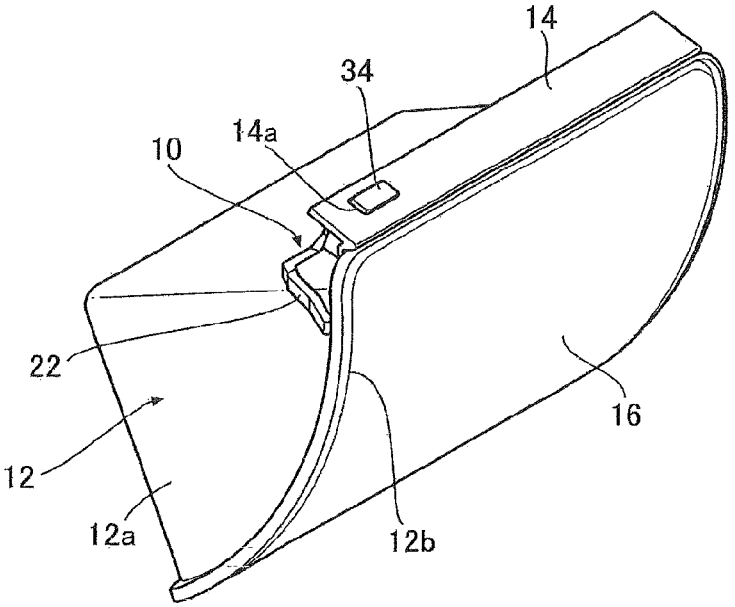
FIGS. 1A and 1B are views illustrating a glove box on which a lock apparatus according to an embodiment is installed.
Figure 1B:
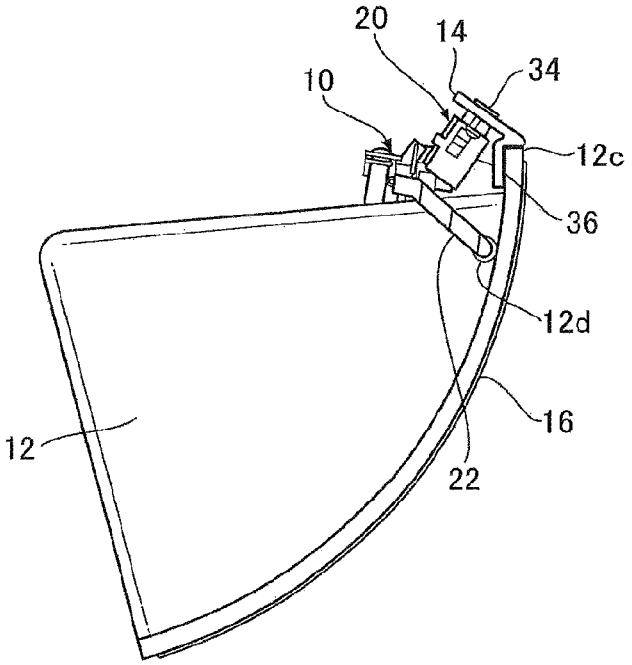
Figure 2:
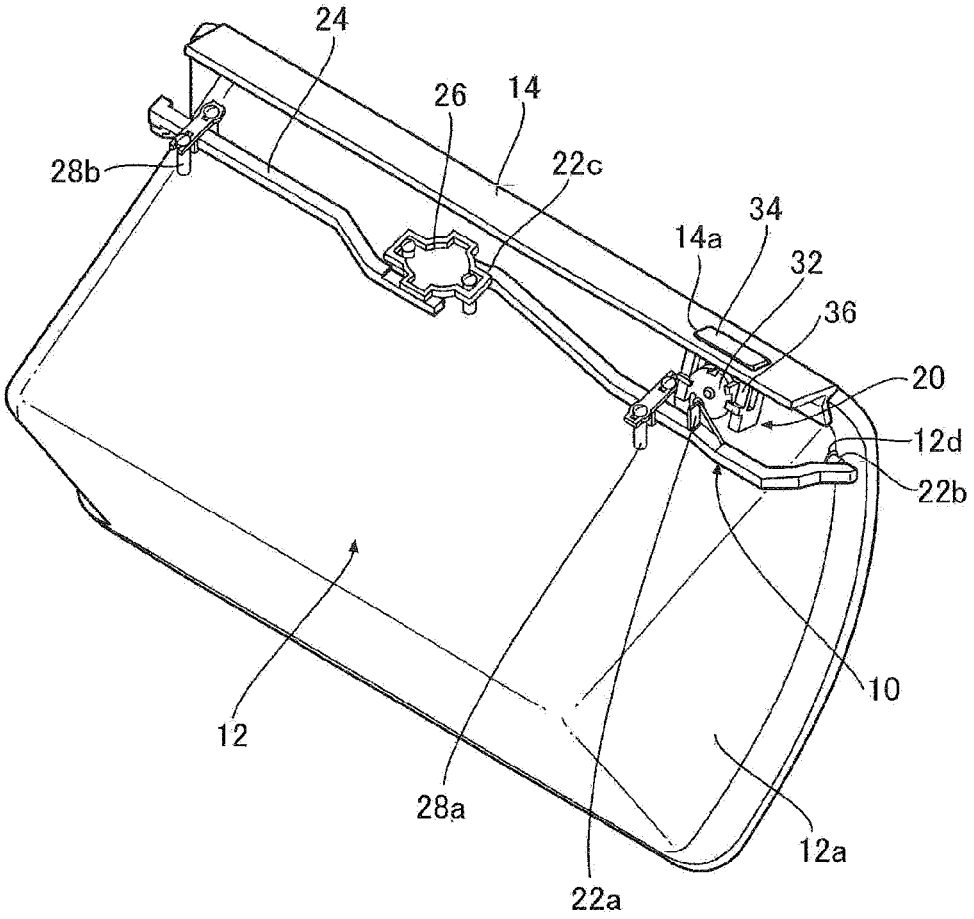
FIG. 2 is a view illustrating the lock apparatus installed on the glove box.

FIGS. 1A and 1B are views illustrating a glove box 12 on which a lock apparatus 10 according to an embodiment is installed. FIG. 1A is a perspective view showing the glove box 12 as viewed from above, and FIG. 1B is a side view showing the glove box 12. FIG. 2 is a view illustrating the lock apparatus 10 installed on the glove box 12. The same or similar components shown in the respective drawings are designated by the same reference numerals and overlapped explanations are omitted appropriately.

The glove box 12 has a box-shaped body section 12*a*, and an opening/closing member 16 is provided on the opening section 12*b* of the body section 12*a*. The opening/closing member 16 can open and close the opening section 12*b* and is locked by the lock apparatus 10 when the opening section 12*b* is in a closed state, thereby maintaining the opening section 12*b* in the closed state.

As shown in FIG. 2, the lock apparatus 10 is equipped with a lock-release apparatus 20 to which the operation force of the user is input; a first locking bar 22 being movable in an unlocking direction by the operation force transmitted via the lock-release apparatus 20; a connection mechanism 26 connected to the first locking bar 22; and a second locking bar 24 to which the operation force is transmitted via the connection mechanism 26. The first locking bar 22, the second locking bar 24 and the connection mechanism 26 are collectively referred to as "locking member".

The lock-release apparatus 20 is equipped with a rotation member 32, an operation member 34, a case member 36, a spring member (not shown) and a cushion (not shown) and these components are formed into one unit. When the user pushes the operation member 34 of the lock-release apparatus 20, the rotation member 32 is rotated in synchronization with the pushing.

The receiving section 22*a* of the first locking bar 22 is formed so as to protrude in the middle of the first locking bar 22 in a wall shape and is connected to the rotation member 32. When the rotation member 32 is rotated, the first locking bar 22 receives the rotation force of the rotation member 32 from the receiving section 22*a* and is moved in the longitudinal direction thereof.

As shown in FIG. 2, one end section 22*b* of the first locking bar 22 is bent and engaged with the side section of the opening/closing member 16 so as to be lockable. The other end section 22*c* of the first locking bar 22 is connected to the connection mechanism 26. One end section and the other end section of the second locking bar 24 are connected to the connection mechanism 26 and are lockable to the opening/closing member 16 as in the case of the first locking bar 22. The first locking bar 22 and the second locking bar 24 are guided by arch-shaped guide sections 28*a* and 28*b* so that the longitudinal movements thereof are not largely dislocated in different directions.

The connection mechanism 26 is rotatably installed on the body section 12*a* and transmits the force received from the first locking bar 22 to the second locking bar 24. When the connection mechanism 26 is rotated, both the first locking bar 22 and the second locking bar 24 are moved in the longitudinal direction thereof, and the opening/closing member 16 is moved in a locking direction or an unlocking direction depending on the rotation.

When the first locking bar 22 is moved in the longitudinal direction by the lock-release apparatus 20, the connection mechanism 26 is rotated and torque is transmitted to the second locking bar 24, and the second locking bar 24 is moved in the longitudinal direction. The connection mechanism 26 may be provided with a spring member (not shown) for urging the first locking bar 22 and the second locking bar 24 in the locking direction.

As shown in FIG. 1B, a plate-shaped side edge section 14 is secured to the upper edge section 12*c* of the body section 12*a*, and the operation member 34 of the lock apparatus 10 is exposed through the button hole 14*a* of the side edge section 14. Although the button hole 14*a* and the lock-release apparatus 20 are provided on the left side of the side edge section 14 shown in FIG. 1A, they may be provided on the right side. The side edge section 14 is part of the instrument panel of the vehicle.

The button hole 14*a* of the side edge section 14 is directed obliquely upward and the operation member 34 is also directed obliquely upward. The operation member 34 is a push button. When the user pushes the operation member 34 obliquely downward, the opening/closing member 16 is unlocked and opened. The opening/closing member 16 is directed obliquely downward and is configured so as to open by its own weight.

As shown in FIGS. 1B and 2, on the side face of the body section 12*a*, a locking hole 12*d* is formed so as to pass through, and the locking hole (not shown) of the opening/closing member 16 is formed in the innermost portion of the locking hole 12*d*. The one end section 22*b* of the first locking bar 22 is inserted into the locking hole 12*d* and enters the locking hole of the opening/closing member 16, whereby the opening/closing member 16 is locked in a closed state.

The glove box 12 is installed on the vehicle body in the state shown in FIG. 1B, and the lock apparatus 10 is secured to the body section 12*a* and the side edge section 14. In particular, the lock-release apparatus 20 is installed so that the operation member 34 of the lock-release apparatus 20 is exposed obliquely upward.

In the rotation member 32 of the lock-release apparatus 20 secured to the glove box 12, when the first locking bar 22 is connected to the rotation member 32 of the lock-release apparatus 20, the connection portion of the rotation member 32 to the first locking bar 22 is preferably directed upward from the viewpoint of ease of assembly. For example, the side edge section 14 constituting the instrument panel provided in front of the front passenger seat is directed toward the windshield and extended in the horizontal direction. Hence, it is preferable that the lock-release apparatus 20 should be formed in a small size in the direction orthogonal to the sliding direction of the operation member 34 in consideration of the space between the instrument panel and the body section 12*a* of the glove box 12.

Figure 3A:
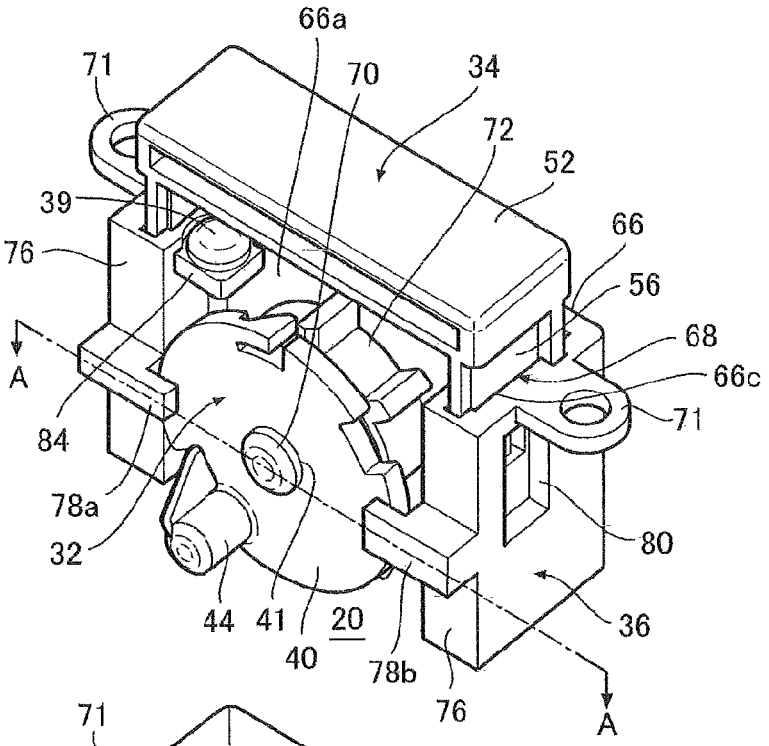
FIGS. 3A and 3B are views illustrating a lock-release apparatus.
Figure 3B:
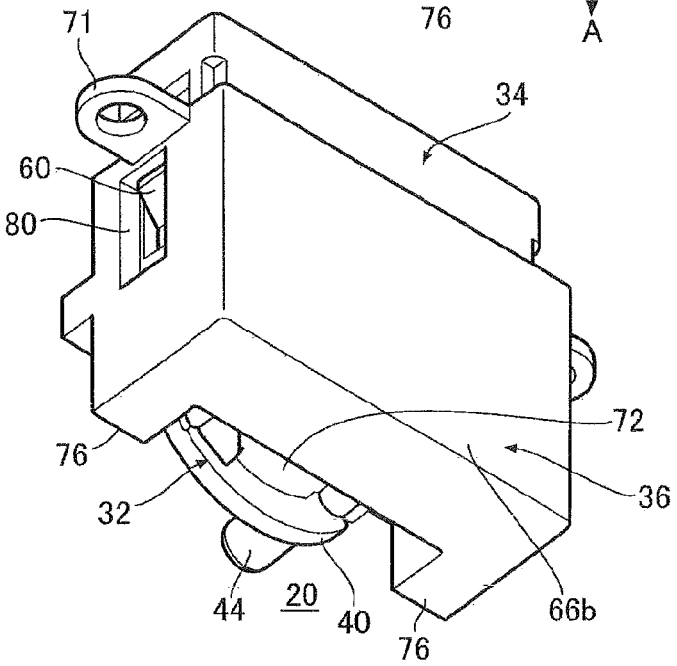

FIGS. 3A and 3B are views illustrating the lock-release apparatus 20. FIG. 3A is a perspective view showing the lock-release apparatus 20 as viewed from the front side, and FIG. 3B is a perspective view showing the lock-release apparatus 20 as viewed from the back side.

The rotation member 32 converts the sliding motion input to the operation member 34 into a rotational motion and transmits torque to the first locking bar 22, thereby moving the first locking bar 22. As shown in FIG. 3A, the rotation member 32 has an actuation section 44 that rotates to move the first locking bar 22. The actuation section 44 is formed so as to protrude from the disc section 40 of the rotation member 32 in the direction perpendicular to the face thereof and makes contact with the receiving section 22*a* of the first locking bar 22 shown in FIG. 2. The rod-shaped support section 70 of the case member 36 is inserted into the center axial hole 41 of the rotation member 32, whereby the rotation member 32 is rotatably supported by the case member 36.

The case member 36 supports the rotation member 32 and accommodates part of the operation member 34. The case member 36 holds the rotation member 32 so that the rotation member 32 does not come off from the support section 70 using the first rotor holding section 78*a* and the second rotor holding section 78*b* thereof.

The case member 36 has an accommodation section 66 in which an accommodation space 68 for accommodating part of the operation member 34 is formed, and an opening 66*c* in which the operation member 34 is inserted is provided in the accommodation section 66. Installation sections 71 for installing the case member 36 on the side edge section 14 are formed on the outer face of the case member 36.

The operation member 34 is partially inserted into the accommodation section 66 of the case member 36, and the flat-shaped operation section 52 of the operation member 34 that is pushed by the user with a finger is exposed. Coming-off preventing sections 60 of the operation member 34 shown in FIG. 3B are formed into a pawl shape and engaged with coming-off preventing grooves 80 formed on the side faces of the case member 36, thereby preventing the operation member 34 from coming off.

The operation member 34 is slidably held by the case member 36 and stops sliding when making contact with a cushion 39 made of rubber shown in FIG. 3A. The operation member 34 is provided so as to be slidable in a nearly horizontal direction with respect to the rotation plane of the rotation member 32. The rotation plane of the rotation member 32 is parallel to the plane of the disc section 40 and is orthogonal to the rotation axis of the rotation member 32.

Hence, the disc section 40 of the rotation member 32 is disposed along the sliding direction, whereby the lock-release apparatus 20 can be made compact in the direction orthogonal to the sliding direction. Furthermore, in the case that the lock-release apparatus 20 is installed on the glove box 12, the actuation section 44 of the rotation member 32 can be disposed upward, whereby the work for the connection to the first locking bar 22 can be facilitated. The respective components of the lock-release apparatus 20 described above will be described below in detail referring to additional drawings.

Figure 4A:
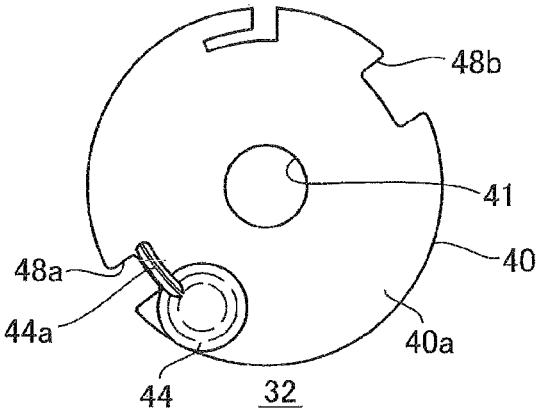
FIGS. 4A, 4B and 4C are views illustrating a rotation member.
Figure 4B:
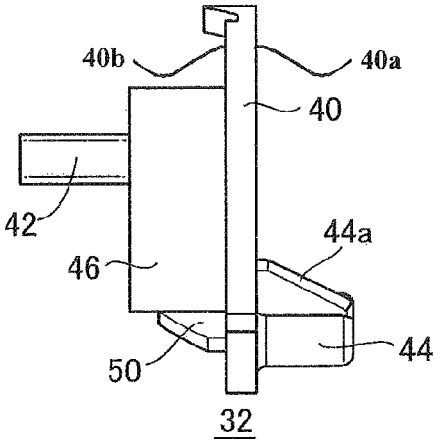
Figure 4C:
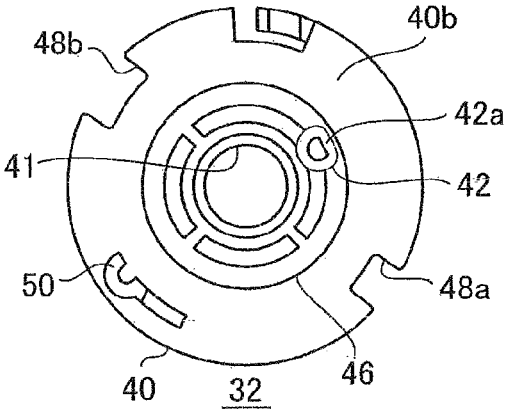

FIGS. 4A, 4B and 4C are views illustrating the rotation member 32. FIG. 4A is a back side view showing the rotation member 32, FIG. 4B is a side view showing the rotation member 32, and FIG. 4C is a front side view showing the rotation member 32. The axial hole 41 is formed as a through hole at the center of the disc section 40 and functions as the rotation axis of the rotation member 32.

As shown in FIG. 4B, the rotation member 32 is formed of the actuation section 44 protruding from the front face 40*a* of the disc section 40 and a protruding section 42 protruding to the back side. The actuation section 44 and the protruding section 42 respectively protrude in parallel in opposite directions. The operation force transmitted from the operation member 34 to the protruding section 42 is output from the actuation section 44. The rotation member 32 pushes the outer circumferential face of the actuation section 44 against the receiving section 22*a* of the first locking bar 22, thereby outputting the operation force.

As shown in FIGS. 4A and 4C, the actuation section 44 is formed outside the protruding section 42 in the radial direction so that the distance of the actuation section 44 from the center axis is longer than that of the protruding section 42. With this configuration, the operation force applied to the protruding section 42 can be made larger by the actuation section 44 and can be output. Of the portions of the outer circumferential face of the protruding section 42, the outside portion 42*a* of the rotation member 32 in the radial direction is formed into a flatter shape than the inside portion. The rotation locus of the outside portion 42*a* of the protruding section 42 can be made smaller by forming the outside portion 42*a* of the protruding section 42 into a recessed shape.

On the actuation section 44 having a cylindrical shape, a wall-shaped rib 44*a* for high rigidity is formed in the range from the disc section 40 to the outer face of the actuation section 44. The spring support section 46 shown in FIGS. 4B and 4C is a cylinder having a diameter approximately half that of the disc section 40. The spring support section 46 is enclosed by a coil-shaped spring member and suppresses the spring member from being deformed excessively inward in the radial direction. The spring support section 46 protrudes from the back face 40*b* of the disc section 40 so as to be coaxial with the disc section 40, and the protruding section 42 further protrudes from the tip end of the spring support section 46.

A first insertion opening 48*a* and a second insertion opening 48*b* are formed so as to cut out the outer circumference of the disc section 40. The circumferential widths of the first insertion opening 48*a* and the second insertion opening 48*b* are made different from each other, whereby, when the rotation member 32 is assembled with the case member 36, they are prevented from being assembled incorrectly.

A spring end receiving section 50 is formed so as to protrude on the side of the back face 40*b* of the disc section 40 and is engaged with the end section of the spring member. The spring end receiving section 50 is provided outside the spring support section 46 in the radial direction and inside the outer circumferential end of the disc section 40 in the radial direction.

Figure 5A:
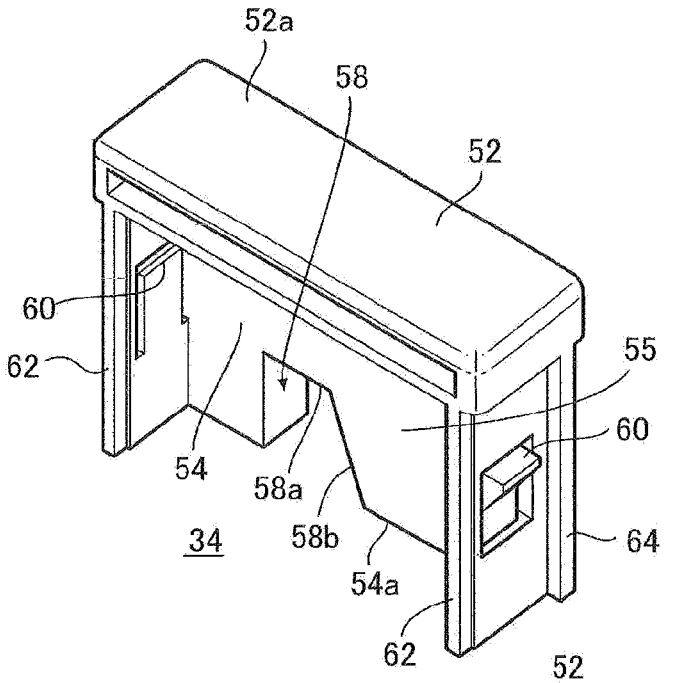
FIGS. 5A and 5B are views illustrating an operation member.
Figure 5B:
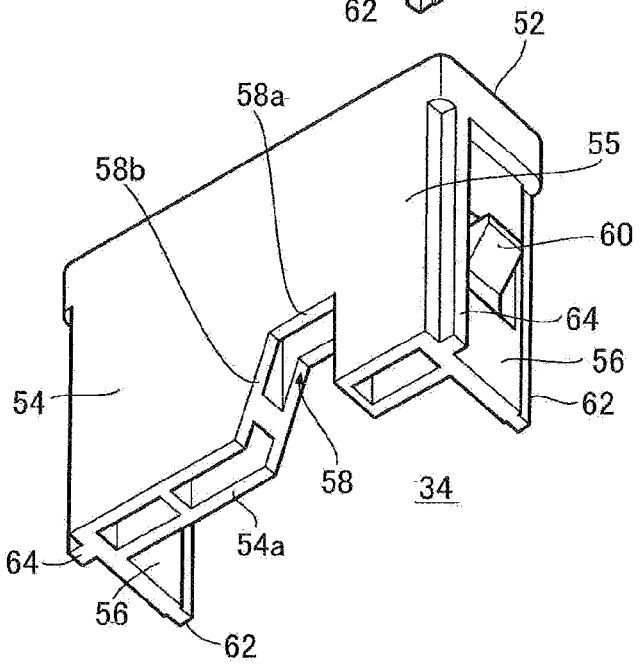

FIGS. 5A and 5B are views illustrating the operation member 34. FIG. 5A is a perspective view showing the operation member 34 as viewed from the front side, and FIG. 5B is a perspective view showing the operation member 34 as viewed from the back side. The operation member 34 has a function of sliding when pushed by the user and has a function of rotating the rotation member 32 by the sliding.

The operation member 34 has the flat rectangular operation section 52 having a flat operation face 52*a* as shown in FIG. 5A and has a flat base section 54 extending from one longitudinal side of the operation face 52*a* to the direction orthogonal to the operation face 52*a* as shown in FIG. 5B.

The base section 54 has a flat plate section 55 and a pair of side sections 56 formed into a flat rectangular shape on both sides of the flat plate section 55. Each of the pair of side sections 56 has the coming-off preventing section 60 protruding outside in the middle of the side section 56, and the coming-off preventing section 60 is an elastic pawl and prevents the operation member 34 from coming off from the case member 36.

The longitudinal direction of the side sections 56 is the sliding direction of the operation member 34, and first rail sections 62 and second rail sections 64 are formed in the longitudinal direction of the side sections 56 (these rail sections are referred to as "rail sections" in the case that they are not distinguished).

The rail sections are formed into a rib shape and extend from the operation section 52 to the tip end 54*a* of the base section 54. Since the rail sections are formed so as to be long, the operation member 34 is suppressed from wobbling with respect to the case member 36, whereby the sliding of the operation member 34 can be made stable. The first rail sections 62 and the second rail sections 64 protrude from the base section 54 in directions orthogonal to each other. Hence, the operation member 34 is suppressed from wobbling with respect to the area therearound. The rail sections are not always required to be formed so as to extend continuously but may be formed so as to be discontinued in the middle of the sliding direction.

An engaging section 58 is formed on the side of the tip end 54*a* of the base section 54 so as to cut out the base section 54. The contact face 58*a* of the engaging section 58 is formed between the tip end 54*a* of the base section 54 and the operation section 52 at the position where the base section 54 is recessed from the tip end 54*a* of the base section 54 toward the side of the operation section 52.

The contact face 58*a* makes contact with the protruding section 42 of the rotation member 32, and when the operation member 34 slides, the contact face 58*a* pushes the protruding section 42 in the sliding direction of the operation member 34 and rotates the operation member 34. Since the contact face 58*a* making contact with the protruding section 42 of the rotation member 32 is formed on the side of the operation section 52 instead of the tip end 54*a*, i.e., the deepest portion, of the base section 54, the disc section 40 of the rotation member 32 is opposed to the base section 54 and the rotation member 32 and the base section 54 are disposed so as to be overlapped with each other in the direction orthogonal to the sliding direction, whereby the lock-release apparatus 20 can be made compact. Since a sufficient length is secured for the base section 54, the rigidity of the operation member 34 can be secured.

An inclined face 58*b* connected to the contact face 58*a* is formed on one side face of the engaging section 58. The protruding section 42 of the rotation member 32, which is rotated and moved, is dislocated in the direction of intersecting the sliding direction of the operation member 34. By the inclined face 58*b*, the size of the engaging section 58 can be suppressed from becoming larger and the rigidity of the operation member 34 can be suppressed from becoming lower while the rotation locus along which the protruding section 42 can move is made larger.

Figure 6A:
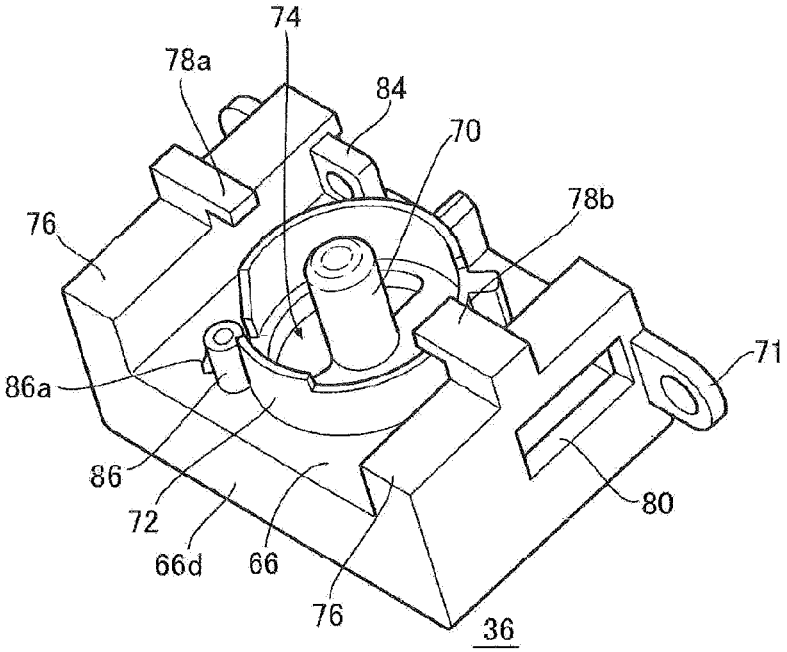
FIGS. 6A and 6B are views illustrating a case member.
Figure 6B:
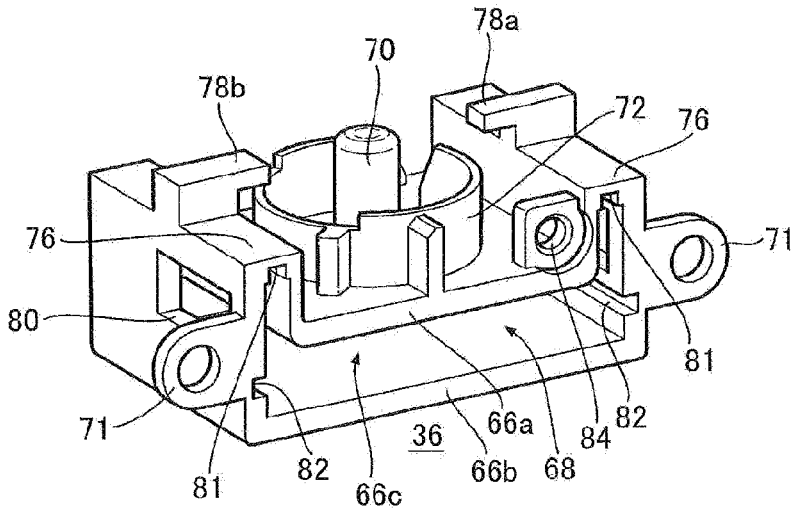

FIGS. 6A and 6B are views illustrating the case member 36. FIG. 6A is a perspective view showing the case member 36 as viewed from the front side, and FIG. 6B is a perspective view showing the case member 36 as viewed from the back side. The case member 36 is secured to the side edge section 14 of the glove box 12. The case member 36 slidably supports the operation member 34 while rotatably supporting the rotation member 32.

As shown in FIG. 6B, the accommodation section 66 of the case member 36 has an accommodation space 68 in which the base section 54 of the operation member 34 is slidably accommodated. The front side wall section 66*a* and the back side wall section 66*b* of the accommodation section 66 are opposed to each other, and the accommodation space 68 is formed therebetween. The accommodation section 66 has a pair of stepped sections 76 formed on both sides thereof in the width direction so as to correspond to the side sections 56 of the operation member 34. The pair of stepped sections 76 protrudes in a stepped shape on the front side of the case member 36.

On the inner face of the accommodation section 66, first rail grooves 81 and second rail grooves 82 (these are referred to as "rail grooves" in the case that they are not distinguished) are formed in the range from the opening 66*c* toward the bottom section 66*d* on the innermost side. The first rail grooves 81 and the second rail grooves 82 are engaged with the first rail sections 62 and the second rail sections 64 of the operation member 34, respectively, thereby guiding the sliding of the operation member 34.

The coming-off preventing groove 80 is formed on each side face of the accommodation section 66 and is formed along the rail grooves in the longitudinal direction. Inside the coming-off preventing groove 80, the coming-off preventing section 60 of the operation member 34 moves.

The first rotor holding section 78*a* and the second rotor holding section 78*b* are formed on the pair of stepped sections 76, respectively. The first rotor holding section 78*a* and the second rotor holding section 78*b* are opposed to each other and protrude from the stepped sections 76 so as to approach each other.

The support section 70 having a cylindrical shape stands upright at the center of the front side wall section 66*a* of the accommodation section 66 and functions as the support shaft of the rotation member 32. A spring enclosing section 72 having a cylindrical shape stands upright from the front side wall section 66*a* while enclosing the support section 70.

A slit 74 having a nearly semicircular shape is formed in the front side wall section 66*a* positioned inside the spring enclosing section 72 in the radial direction. The slit 74 is an opening for the link structure for the connection between the rotation member 32 and the operation member 34.

A spring end receiving section 86 is formed on the outside of the spring enclosing section 72 in the radial direction and supports one end of the spring member. The spring end holding section 86*a* of the spring end receiving section 86 protrudes outward in the radial direction from the outer circumferential face of the spring end receiving section 86 and is formed away from the front side wall section 66*a*. The spring end holding section 86*a* restricts the axial movement of the end section of the spring member hooked to the spring end receiving section 86, thereby suppressing the seat section of the spring member from moving in the axial direction and suppressing the end section of the spring member from coming off.

A cushion holder 84 having a shape of a hole is formed on the side of the opening 66*c* in the front side wall section 66*a* of the accommodation section 66. The cushion holder 84 holds the cushion 39 inserted therein.

Figure 7:
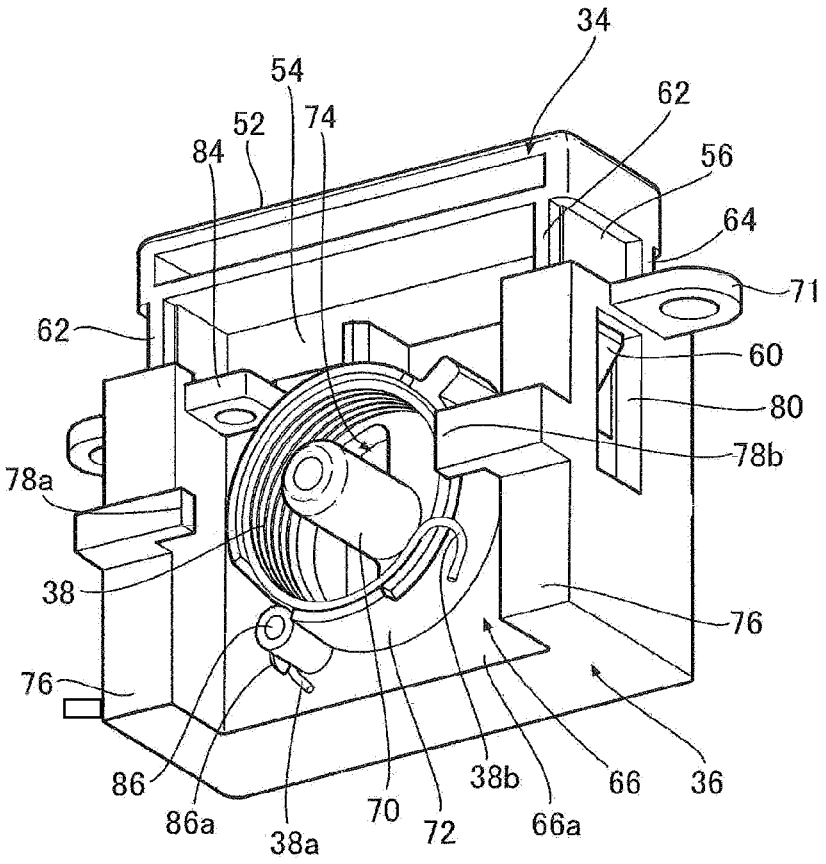
FIG. 7 is a view illustrating the internal structure of the lock-release apparatus.

FIG. 7 is a view illustrating the internal structure of the lock-release apparatus 20 and is a perspective view showing the lock-release apparatus 20 from which the rotation member 32 and the cushion 39 are removed. A spring member 38 wound in a coil shape is disposed so as to make contact with or become close to the inner circumference of the spring enclosing section 72, whereby the outward movement of the spring in the radial direction is restricted. Since the spring member 38 is accommodated inside the spring enclosing section 72, the lock-release apparatus 20 can be made compact.

The first spring end section 38*a* of the spring member 38 is engaged with the spring end receiving section 86 of the case member 36. The second spring end section 38*b* of the spring member 38 is engaged with the rotation member 32. The slit 74 is positioned inside the spring member 38 in the radial direction.

The coming-off preventing sections 60 of the operation member 34 enter the coming-off preventing grooves 80 of the case member 36, thereby prevented from coming off and slidably supported in the case member 36. The support section 70 shown in FIG. 7 is inserted into the axial hole 41 of the rotation member 32 shown in FIG. 4, whereby the rotation member 32 is installed in the lock-release apparatus 20. When the rotation member 32 is installed, the first insertion opening 48*a* and the second insertion opening 48*b* of the rotation member 32 are passed through the first rotor holding section 78*a* and the second rotor holding section 78*b*, respectively. The width of the second rotor holding section 78*b* is made larger than the width of the first insertion opening 48*a* so that the second rotor holding section 78*b* cannot pass through the first insertion opening 48*a*, whereby they are prevented from being assembled incorrectly.

Figure 8:
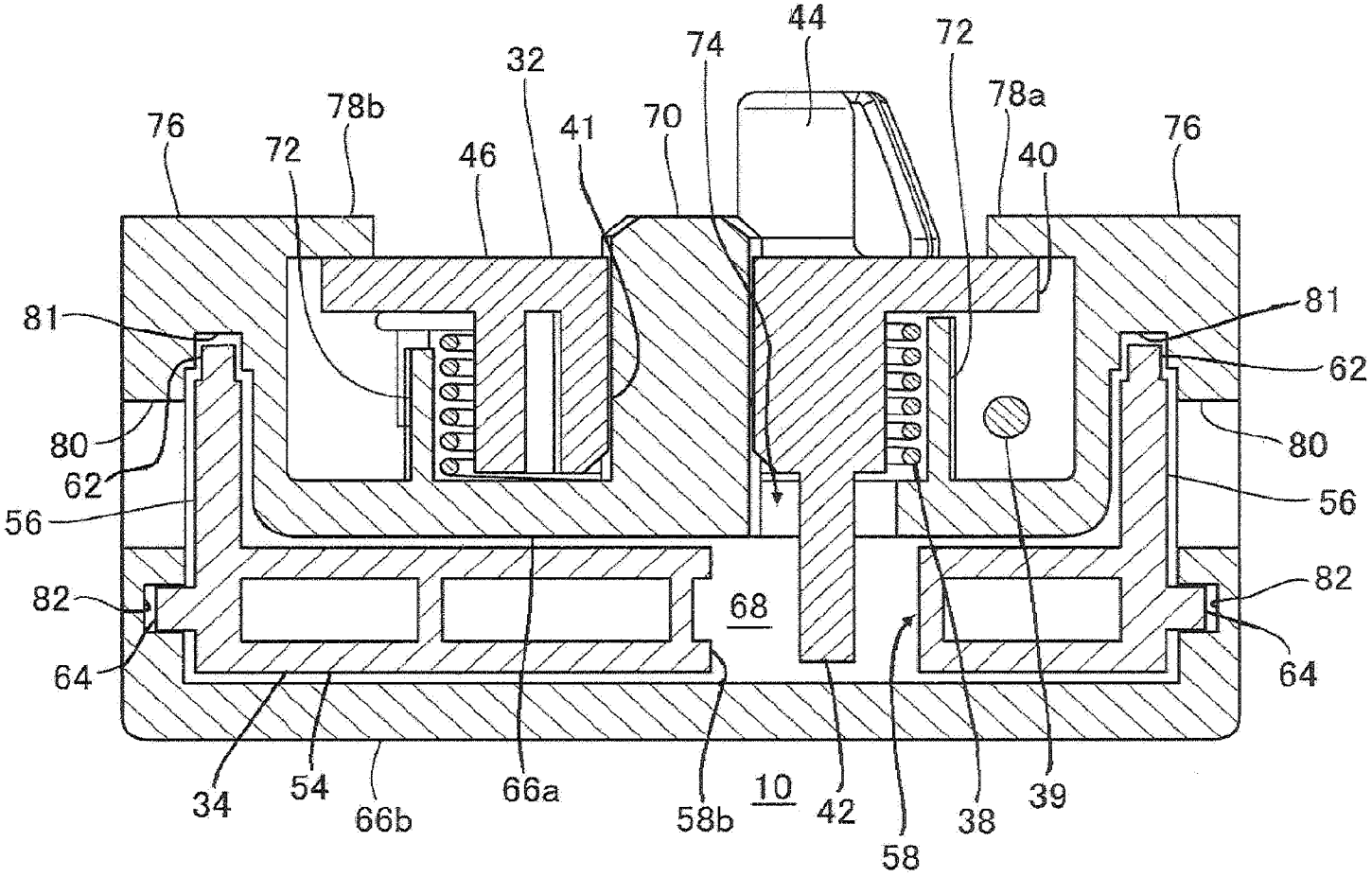
FIG. 8 is a cross-sectional view showing the lock-release apparatus taken on line A-A in FIG. 3A.

FIG. 8 is a cross-sectional view showing the lock-release apparatus 20 taken on line A-A in FIG. 3A. FIG. 8 shows the cross-section of the lock-release apparatus 20 in the direction orthogonal to the sliding direction of the operation member 34. The rotation member 32 is rotatably supported by the support section 70 of the case member 36 and is prevented from coming off by the first rotor holding section 78*a* and the second rotor holding section 78*b*.

The spring member 38 is disposed between the spring support section 46 of the rotation member 32 and the spring enclosing section 72 of the case member 36, whereby the deformation and movement of the spring member 38 are restricted. The protruding section 42 of the rotation member 32 is inserted into the slit 74 of the case member 36 and protrudes into the accommodation space 68.

The protruding section 42 protruding into the accommodation space 68 is positioned inside the engaging section 58 of the operation member 34. The first rail sections 62 and the second rail sections 64 of the operation member 34 enter the first rail grooves 81 and the second rail grooves 82, respectively, whereby the movement of the operation member 34 in the direction orthogonal to the sliding direction is limited. Since the rotation member 32 is disposed between the pair of side sections 56 and between the pair of stepped sections 76, the downsizing of the lock-release apparatus 20 is attained.

Figure 9A:
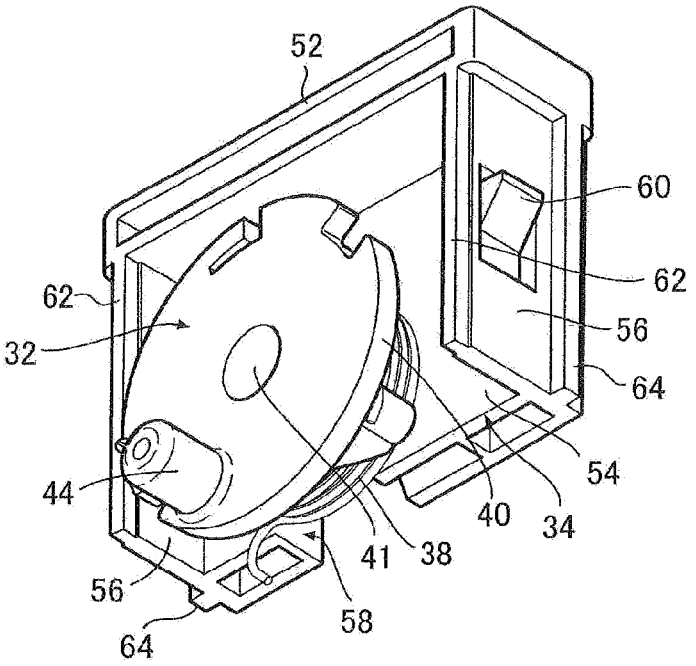
FIGS. 9A and 9B are views illustrating the positional relationship among the rotation member, the operation member and the spring member in the lock-release apparatus.
Figure 9B:
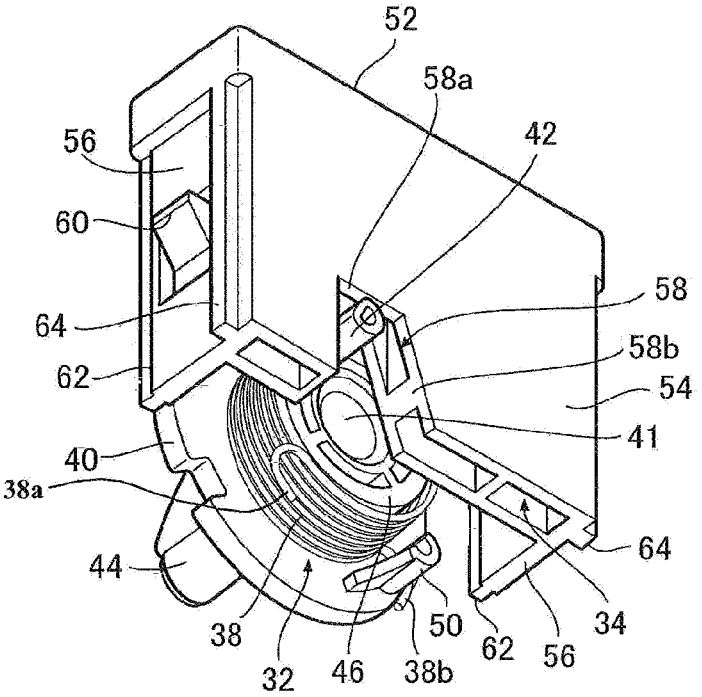

FIGS. 9A and 9B are views illustrating the positional relationship among the rotation member 32, the operation member 34 and the spring member 38 in the lock-release apparatus 20. As shown in FIG. 9A, the rotation member 32 is disposed between the pair of side sections 56 of the operation member 34, and the spring member 38 is disposed between the rotation member 32 and the base section 54 of the case member 36. With this configuration, the space for the spring member 38 can be reduced and the lock-release apparatus 20 can be made compact.

As shown in FIG. 9B, the spring member 38 is disposed so as to be wound around the spring support section 46 of the rotation member 32. The protruding section 42 of the rotation member 32 is disposed in the direction perpendicular to the face of the base section 54 of the operation member 34 and enters the engaging section 58.

The rotation member 32 is urged by the spring member 38 in a first rotation direction, i.e., the counterclockwise direction in FIG. 9B, and the protruding section 42 makes contact with the contact face 58*a* of the operation member 34 and acts in the direction of raising the operation member 34. When the operation member 34 is pushed downward, the contact face 58*a* pushes down the protruding section 42, and the rotation member 32 is rotated against the urging force of the spring member 38. When the user stops pushing the operation member 34 and releases his finger, the rotation member 32 is rotated by the urging force of the spring member 38 in the direction of pushing back the operation member 34. The spring member 38 acts so as to push back the operation member 34, thereby moving the first locking bar 22 and the second locking bar 24 in the locking direction.

The base section 54 of the operation member 34 and the disc section 40 of the rotation member 32 are disposed so as to be nearly parallel to each other. The operation member 34 is installed so as to be slidable in the direction nearly parallel to the rotation plane of the rotation member 32. Hence, the thickness of the lock-release apparatus 20 in the direction orthogonal to the sliding direction can be made thinner than the thickness in the case that the disc section 40 is disposed so as to be orthogonal to the base section 54. A link structure is configured by the connection of the protruding section 42 to the contact face 58*a* formed so as to cut out the base section 54, whereby this simple configuration of the link structure does not require additional link components and the lock-release apparatus 20 can be made compact.

As shown in FIG. 2, when the lock-release apparatus 20 is secured to the glove box 12 and the first locking bar 22 is connected to the rotation member 32 of the lock-release apparatus 20, the actuation section 44 of the rotation member 32 is directed upward, whereby the connection of the rotation member 32 to the first locking bar 22 can be facilitated.

Figure 10A:
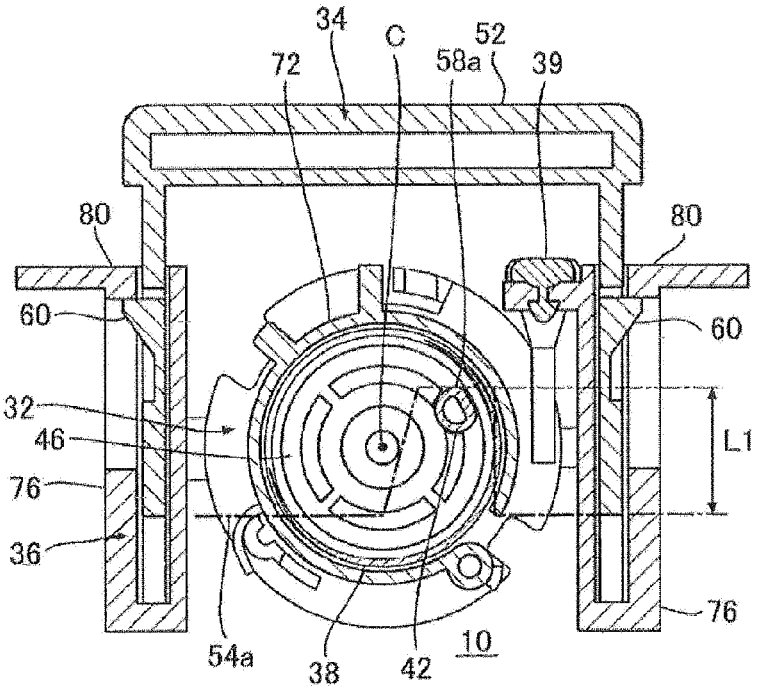
FIGS. 10A and 10B are views illustrating the operation of the lock-release apparatus.
Figure 10B:
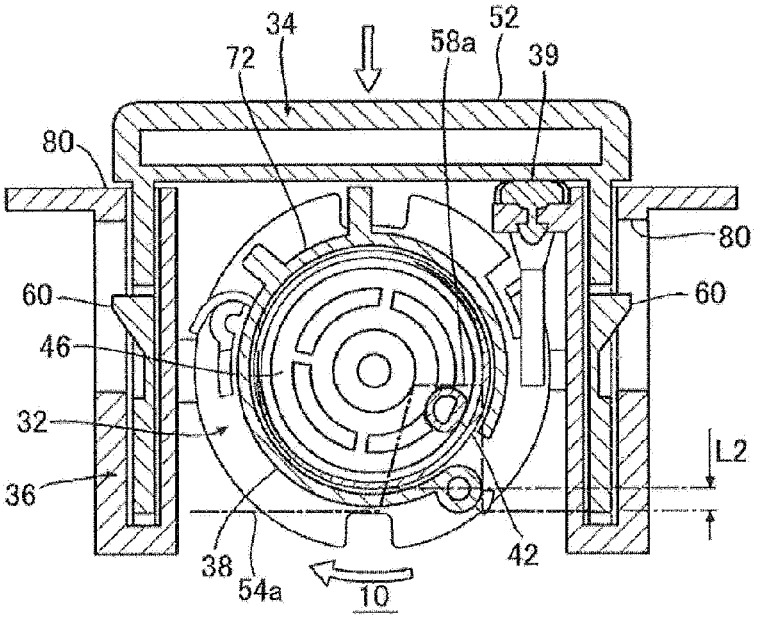

FIGS. 10A and 10B are views illustrating the operation of the lock-release apparatus 20 and showing the cross-section of the lock-release apparatus 20 in the sliding direction. FIG. 10A shows the regular state of the lock-release apparatus 20 and FIG. 10B shows the unlocked state of the lock-release apparatus 20 at the time when the lock-release apparatus 20 is operated so as to be shifted from the regular state to the unlocked state.

As shown in FIG. 10A, the protruding section 42 of the rotation member 32 acts in the direction of pushing the contact face 58*a* of the operation member 34 out of the accommodation section 66 by the urging force of the spring member 38, and the operation member 34 is in a state of being restricted to move by the coming-off preventing sections 60 and the coming-off preventing grooves 80.

As shown in FIG. 10B, when the operation member 34 is pushed in the sliding direction, the contact face 58*a* pushes the protruding section 42 to rotate the rotation member 32. The operation section 52 makes contact with the cushion 39 and the pushing stops. By the rotation of the rotation member 32, the first locking bar 22 connected thereto is moved and the locking is released.

The link structure of the protruding section 42 and the contact face 58*a* is disposed on the inside diameter side of the spring member 38 as viewed from the axial direction of the rotation member 32, whereby the rotation radius of the protruding section 42 can be made small and the rotation angle of the rotation member 32 with respect to the sliding distance can be made large. The rotation radius of the actuation section 44 is made larger than that of the protruding section 42, whereby the movement distance of the actuation section 44 of the rotation member 32 with respect to the sliding distance of the operation member 34 can be made large.

The first rail sections 62 and the second rail sections 64 of the operation member 34 shown in FIG. 9B are formed so as to extend to the tip end side along the sliding direction beyond the contact face 58*a*. The contact face 58*a* shown in FIG. 10A is formed at the position recessed from the tip end 54*a* of the base section 54 to the side of the operation section 52 by a first distance L1. With this configuration, the length of the rail sections of the operation member 34 can be secured sufficiently in the sliding direction, the rigidity of the operation member 34 in the sliding direction can be secured, and the operation member 34 is suppressed from wobbling during the sliding. The rotation member 32 can be disposed on the side of the operation section 52, and the length of the lock-release apparatus 20 in the sliding direction can be made small.

The first rail sections 62 and the second rail sections 64 extend from the operation section 52 to the same position as the tip end 54*a* of the base section 54. The rail sections are formed so as to extend beyond the rotation center C of the rotation member 32 to the side of the tip end 54*a* of the base section 54 along the sliding direction. In other words, the rotation center C of the rotation member 32 is positioned on the side of the operation section 52 from the tip ends of the rail sections. Hence, the length of the rail sections of the operation member 34 can be secured sufficiently.

As shown in FIG. 10B, in the unlocked state in which the operation member 34 is pushed, the spring member 38 is positioned on the side of the operation section 52 from the tip end 54*a* of the base section 54 by a second distance L2. In other words, the rail sections and the rail grooves are formed so as to extend to the tip end side beyond the spring member 38 along the sliding direction. Hence, the length of the lock-release apparatus 20 in the sliding direction can be made small while the length of the rail sections in the sliding direction are secured sufficiently.

The present invention is not limited to the above-mentioned embodiments, but modifications such as various design changes can be made to the embodiments on the basis of the knowledge of those skilled in the art, and such modified embodiments can also be included in the scope of the present invention.

In the above embodiment, the lock-release apparatus 20 and the locking members, such as the first locking bar 22 and the second locking bar 24, are installed on the instrument panel sides of the side edge section 14 and the body section 12*a*. However, the present invention is not limited to this mode. For example, the lock-release apparatus 20 and a locking member may be installed on the opening/closing member 16. The lock-release apparatus 20 is secured in the accommodation space inside the opening/closing member 16, and the operation member 34 of the lock-release apparatus 20 is exposed from the button hole formed in the opening/closing member 16. The locking member is movably supported in the accommodation space inside the opening/closing member 16, and the tip end section thereof protrudes from the locking hole formed in the opening/closing member 16. The tip end section of the locking member enters the locking hole formed in the inside face of the body section 12*a*, whereby the opening section 12*b* is maintained in the closed state by the opening/closing member 16.

The lock-release apparatus 20 may be installed on the side edge section of the glove box 12 and a locking member may be installed on the opening/closing member 16. The lock-release apparatus 20 is secured to the outside face of the body section 12*a* of the glove box 12, and a connection hole is formed in the side face of the body section 12*a* adjacent to the lock-release apparatus 20. A connection hole is formed in one side face of the opening/closing member 16 and a locking hole is formed in the other side face thereof. The locking member is movably supported by the opening/closing member 16, one end of the locking member is drawn out of the locking hole formed in the opening/closing member 16 and is engaged with the locking hole formed in the inside face of the body section 12*a*, whereby the opening section 12*b* is maintained in the closed state by the opening/closing member 16. The other end of the locking member is drawn out of the connection hole formed in the opening/closing member 16 and is connected to the rotation member 32 of the lock-release apparatus 20. A connection mechanism for converting the movement of the one end of the locking member into the movement in the opposite direction is formed between both ends of the locking member. When the other end of the locking member is moved so as to be pushed into the opening/closing member 16 by the rotation of the rotation member 32, the one end of the locking member is pulled into the opening/closing member 16 and the locking is released.

Although the engaging section 58 of the operation member 34 is formed so as to cut out the tip end 54*a* of the base section 54 in the embodiment, the present invention is not limited to this mode. For example, it may be possible that a through hole is provided in the middle of the base section 54, the protruding section 42 of the rotation member 32 is inserted into the through hole, and the rotation member 32 is connected to the operation member 34. The contact face 58*a* may be formed by cutting out the entire flat plate section 55 while the pair of side sections 56 of the base section 54 remains unremoved. In both the modifications described above, the contact face 58*a* is formed between the tip end 54*a* of the base section 54 and the operation section 52. In another modification, it may be possible that the tip end 54*a* of the base section 54 is not cut out but the tip end of the base section 54 serves as the contact face 58*a*.

Although the connection between the protruding section 42 and the contact face 58*a* has been described as the link structure for connecting the rotation member 32 to the operation member 34 in the embodiment, the present invention is not limited to this mode. For example, it may be possible to use a mode in which a contact face constituting a hole or a dent section is provided in the rotation member 32, a protruding section is provided on the operation member 34, and the contact face is engaged with the protruding section to form a link structure. In other words, the link structure is configured by reversing the relationship between the protrusion and the cut-out in the rotation member 32 and the operation member 34. With this mode, the link structure can also be formed easily. A link structure may also be formed by forming protrusions on the rotation member 32 and the operation member 34 and by engaging the protrusion on the rotation member 32 with the protrusion on the operation member 34.

The invention claimed is:

1. A lock-release apparatus including:

a rotation member including an actuation section being configured to rotate to actuate a locking member;

a case member rotatably supporting the rotation member;

an operation member slidable in a direction substantially in parallel to a rotation plane of the rotation member;

a spring member making contact with both the case member and the rotation member to thereby urge the rotation member in a given rotation direction; and a link structure being configured to convert a sliding movement of the operation member into a rotational movement of the rotation member, wherein the case member includes:

an accommodation section slidably accommodating the operation member to allow an operation face thereof to be exposed; and a support section rotatably supporting the rotation member.

2. The lock-release apparatus of claim 1, wherein the spring member is formed by being wound and disposed so as to enclose the support section, and wherein the link structure is disposed on an inside diameter side of the spring member as viewed from an axial direction.

3. The lock-release apparatus of claim 1, wherein the link structure including:

a protruding section; and an engaging section to be engaged with the protruding section, and wherein one of the protruding section and the engaging section is formed on the operation member and the other thereof is formed on the rotation member.

4. The lock-release apparatus of claim 3, wherein the protruding section is formed on the rotation member, wherein the engaging section is formed on the operation member and has a contact face making contact with the protruding section, and wherein the contact face pushes the protruding section in a direction of sliding of the operation member to thereby rotate the rotation member.

5. The lock-release apparatus of claim 4, wherein the operation member includes a base section extending from the operation face in the direction of sliding of the operation member and being accommodated in the accommodation section, and wherein the contact face is formed on a portion of the operation member within a range from a tip end of the base section to the operation face.

6. The lock-release apparatus of claim 5, wherein the base section includes rail sections extending toward the tip end of the base section in the direction of sliding the operation member beyond the contact face.

7. The lock-release apparatus of claim 6, wherein, in a regular state where the operation member is not operated, the rail sections extend toward the tip end of the base section in the direction of sliding the operation member beyond a rotation axis of the rotation member.

8. A lock apparatus configured to lock an opening/closing member openably and closably installed on an opening section of an install-base member in a closed state, the lock apparatus including:

a locking member capable of being brought into a locked state to thereby hold the opening/closing member when the opening/closing member is closed;

a rotation member including an actuation section configured to rotate to actuate the locking member;

a case member being installed on one of the install-base member and the opening/closing member and rotatably supporting the rotation member;

an operation member slidable in a direction substantially in parallel to a rotation plane of the rotation member;

a wound-formed spring member making contact with both the case member and the rotation member to thereby urge the rotation member in a direction in which the locking member is brought into the locked state; and a link structure configured to convert a sliding movement of the operation member into a rotational movement of the rotation member, wherein the case member includes:

an accommodation section slidably accommodating the operation member to allow an operation face thereof to be exposed; and a support section rotatably supporting the rotation member, and wherein, upon operation on the operation member, the operation member slides to cause the rotation member to rotate via the link structure to thereby actuate the locking member.

* * * * *